United States Patent [19]

Giacomoni

[11] Patent Number: 4,934,166

[45] Date of Patent: Jun. 19, 1990

[54] ROLLING MILL WITH AXIALLY SHIFTABLE ROLLS AND PROCESS FOR ADJUSTING THE PROFILE OF SUCH ROLLS

[75] Inventor: Jacques G. Giacomoni, Rueil Malmaison, France

[73] Assignee: Clecim, Cedex, France

[21] Appl. No.: 160,985

[22] Filed: Feb. 26, 1988

[30] Foreign Application Priority Data

Feb. 27, 1987 [FR] France ..... 8702706

[51] Int. Cl.[5] ..... B21B 31/18

[52] U.S. Cl. ..... 72/247; 72/245

[58] Field of Search ..... 72/247, 243, 245, 20, 72/21

[56] References Cited

U.S. PATENT DOCUMENTS

| | | | |
|---|---|---|---|
| 4,369,646 | 1/1983 | Kajiwara | 72/247 X |
| 4,483,165 | 11/1984 | Yasuda | 72/247 X |
| 4,627,261 | 12/1986 | Schiller | 72/247 |
| 4,773,246 | 9/1988 | Perret | 72/247 |
| 4,803,865 | 2/1989 | Jansen et al. | 72/247 |
| 4,813,259 | 3/1989 | Grocock et al. | 72/247 X |

FOREIGN PATENT DOCUMENTS

| | | | |
|---|---|---|---|
| 3604195 | 8/1987 | Fed. Rep. of Germany | 72/247 |
| 0153504 | 9/1984 | Japan | 72/247 |
| 0006212 | 1/1985 | Japan | 72/247 |
| 0068103 | 4/1985 | Japan | 72/245 |

*Primary Examiner*—W. Donald Bray

*Attorney, Agent, or Firm*—Pollock, Vande Sandy & Priddy

[57] ABSTRACT

A rolling mill with axially shiftable rolls, comprising, inside a supporting stand, at least two working rolls with bending jacks bearing in the direction of the bending force on a T-shaped sliding piece comprising a part forming a foot engaging into a housing machined in the block containing the bending jacks, to allow guidance in a translational movement in the vertical plane, and the chocks of the working rolls bearing on the pieces and thereby receiving the bending force can also shift on the pieces by sliding when the rolls are to be shifted axially.

16 Claims, 7 Drawing Sheets

ROLLING MILL WITH AXIALLY SHIFTABLE ROLLS AND PROCESS FOR ADJUSTING THE PROFILE OF SUCH ROLLS

FIELD OF THE INVENTION

The invention relates to a rolling mill with axially shiftable rolls, as well as to a process for adjusting the profile and inhibiting the wear of the rolls in such a rolling mill.

BACKGROUND OF THE INVENTION

In general terms, a rolling mill comprises, within a supporting stand, at least two working rolls which bear on at least two back-up rolls along a gripping plane. The rolls are carried at their two ends, by means of rolling bearings, in chocks mounted shiftably, parallel to the gripping plane, in apertures provided in each upright of the supporting stand, each chock having two lateral guide faces sliding along corresponding sliding faces formed on the upright of the stand on either side of the chock.

So-called "four-high" rolling mills, comprising two working rolls each bearing on a back-up roll, and so-called "six-high" rolling mills, in which intermediate rolls are interposed between the back-up rolls and the working rolls, are conventionally used. In both cases, the axes of the rolls are placed in the generally vertical gripping plane, but each working roll can also bear in a larger number of intermediate and/or back-up rolls arranged symmetrically on either side of the gripping plane.

To control the thickness of the rolled product and, in particular, to obtain a uniform thickness in the direction transverse to the rolling direction, bending or curving of the working rolls and, if appropriate, of the intermediate rolls is carried out by means of bending devices acting on the chocks of the corresponding roll. The bending device generally consists, for each chock, of two sets of jacks arranged symmetrically on either side of the chock. Moreover, each bearing part of the chock bears on two jacks set axially apart from one another symmetrically on either side of the mid-plane of the rolling bearings of the chock, so that the bending force is effectively distributed over the rolling bearings.

The stand of the rolling mill is symmetrical relative to a mid-plane perpendicular to the gripping plane and corresponding to the mid-plane of the rolled product. The rolls are therefore normally centered on this plane, in relation to which the chocks are arranged symmetrically.

However, it may be advantageous to ensure a shift of some rolls parallel to their axis and in the opposite direction or not, in order to achieve various objectives, such as uniformity of wear of the rolls or control of the planeness or profile of the rolled product.

It can be seen that the axial shift of the rolls presents difficulties when these are subjected to a bending force. Consequently, the two operations are usually carried out separately, the bending force being stopped when an axial shift takes place.

However, it is expedient, during rolling, to combine the effects of axial shift and of bending of the rolls and consequently to make it possible to carry out the axial shift of the rolls while at the same time continuing with bending. Furthermore, the torque is usually exerted on a single pair of rolls, and the bending of the corresponding working rolls takes place as a result of friction. It is necessary that all the rolls should continue to be driven at the same peripheral speed.

Moreover, the bending of the working rolls also ensures a balancing effect between the rolls which it is expedient to maintain during axial adjustment, even when the rolling force is cancelled.

SUMMARY OF THE INVENTION

The object of the invention is a device making it possible to carry out an axial shift of the rolls, without ceasing to exert the bending force.

For this purpose, it has already been proposed to associate with each shiftable roll and with its chocks a frame composed of two beams which are mounted so as to slide axially on the rolling-mill stand and on which bear the bending devices which are thus shifted at the same time as the rolls, their chocks and the frame. However, this arrangement complicates construction of the rolling mill.

The subject of the invention is a new device facilitating simultaneous bending and axial shifting of the working rolls or intermediate rolls, without substantial change in the construction of the rolling mill. In particular, the invention makes it possible to prevent the intense friction between guide surfaces which is capable of disrupting the vertical adjustment shifts of the chocks.

The invention therefore applies to a rolling mill with axially shiftable rolls comprising, inside a supporting stand, at least two working rolls which bear on at least two back-up rolls along a gripping plane and the ends of which are carried, by means of rolling bearings, in chocks mounted so as to slide in the supporting stand, at least one of the working rolls being associated, on the one hand, with means for shifting said roll along its axis on either side of a centering position of the working rolls on the mid-plane of the stand and, on the other hand, with means for bending said roll, comprising for each chock two symmetrical sets of at least two bending jacks set axially apart from one another and acting respectively on bearing parts formed on each side of the chock, said sets of jacks being arranged inside a supporting block fixed to the stand.

According to the invention, each set of bending jacks bears in the direction of the bending force on a sliding piece mounted so as to slide vertically between two pairs of guide faces which are formed in a machined portion produced inside the supporting block and which are respectively parallel and perpendicular to the rolling plane, and the corresponding bearing part of the chock bears, with the possibility of sliding, on a plane and smooth face formed on said sliding piece on the opposite side to the bending jack.

Thus, the bending force is exerted by means of fixed jacks which, at each end, bear on one side on the supporting block fixed to the stand and on the other side on a piece on which the chock can slide during the axial shifts, this piece being mounted on the supporting block so as to slide in the direction of exertion of the bending force and being associated with interlocking means making it possible to withstand the tilting effects in the direction of axial shifting of the rolls.

In a preferred embodiment, the sliding piece comprises parts for the bearing of each bending jack in the bending direction and extending horizontally above each jack, and at least one part in the form of a guide foot extending vertically and engaging between two set-apart faces of the sliding guidance of said foot, which are perpendicular to the rolling plane and which are formed on two opposite faces of the machined portion produced inside the supporting block 5.

In the most usual case, when each bending assembly comprises two jacks set apart from one another and centered in a plane parallel to the rolling plane, the sliding piece has the form of a T comprising a central inner part forming the guide foot and extending vertically between the two jacks inside the supporting block, and an outer part forming two wings extending horizontally on either side of the guide foot, each above one of said jacks.

The guidance obtained in this way makes it possible to withstand the tilting forces arising as a result of the offset of the bearing parts of the chock in relation to the sliding piece during the axial shifts, and because of the length of the guide foot, this takes place with only slight friction and does not impair the vertical shifts.

According to another especially advantageous characteristic, the sliding piece is mounted so as to slide between two guide faces parallel to the rolling plane and formed in a second machined portion provided inside the supporting block and extending outwards the inner machined portion, in which the guide foot engages.

Preferably, these two guide faces parallel to the rolling plane are set apart from one another symmetrically on either side of the plane passing through the axes of the bending jacks, and the bearing part of the chock is itself centered in the same plane, in which all the forces exerted as a result of bending are therefore transmitted.

Thus, when each bending assembly comprises two jacks set apart from one another, the machined portion produced in the supporting block comprises a widened outer part which extends above the two bending jacks and in which is guided the outer part of the T-shaped sliding piece, on which the chock bears on one side and the bending jacks bear on the other side, and an inner part forming a central well, in which the guide foot of the sliding piece is guided.

In most cases, the interlocking effect of the guide foot makes it possible to carry out simultaneous axial shifting and bending of the working rolls, opposing the tilting torque arising as a result of the offset of the mid-plane of the rolling bearing in relation to the plane of symmetry of the two pairs of bending jacks. However, if this offset becomes too great, it results in friction which can oppose the sliding of the sliding piece.

In this case, according to another aspect of the invention, it is expedient to exert different pressures on the two jacks of each pair in the view of the axial offset of the roll, so as to cancel out the sum of the tilting torques exerted on the sliding piece, thus reducing to a minimum the guide friction of this piece.

For this purpose, the offset of the working roll relative to the centering position on the mid-plane of the product is measured on a continuous basis, and for each chock the individual pressure exerted by each jack is adjusted continuously as a function of the offset so measured, in such a way that, for each sliding piece, the torque resulting from the sum of the torques of each bending jack and that of the reaction of the chock is zero.

Advantageously, since the two chocks of each shiftable roll are each associated with two symmetrical sets of bending jacks arranged on either side of the rolling plane, the jacks which, in each of the sets, are placed respectively in the same relative positions in relation to the mid-plane of their respective rolling bearing are connected in parallel to one of the same branch of a common pressurized-fluid feed circuit comprising as many branches as there are jacks in each set, each branch being equipped with a means for the individual adjustment of the pressure of the fluid, with equal flow rates being maintained in all the branches.

The means for the individual adjustment of the pressures in the jacks comprise, on each branch of the feed circuit, a servovalve controlled by a means for calculating the corrections to be made to the pressures as a function of the offset measured and displayed on the calculation means and of the respective positions of the jacks fed via the branch in question.

According to another especially advantageous characteristic of the invention, each chock can be associated with positive bending means, each comprising at least two jacks. These sets of jacks are provided in hydraulic blocks arranged on either side of the gripping plane in the apertures of the stand; each block is composed of a solid supporting piece comprising a central part machined to receive the T-shaped pieces on which the bearing lugs of the chock bear, these each being equipped with the continuous sliding face parallel to the sliding axis.

BRIEF DESCRIPTION OF THE DRAWINGS

Other particular features and advantages of the invention will emerge from the following description of several embodiments given by way of example and illustrated in the accompanying drawings.

FIG. 1 shows schematically a four-high rolling mill comprising two working rolls (1) and (1') and two back-up rolls (2) and (2'). The axes of the rolls are parallel and arranged along a gripping plane P1 passing through the contact generatrices.

The rolled product 20 passes between the working rolls (1) and (1'), and its mid-plane corresponds substantially to the transverse plane of symmetry P2 of the rolling-mill stand as a whole and, in particular, of the back-up rolls (2) and (2'). Normally, the rolls are all aligned and centered on the same mid-plane P2. However, for the reasons given above, the working rolls (1) and (1') can be shifted axially relative to the centering position, in such a way that their respective transverse plane of symmetry is offset on one side or the other relative to the mid-plane P2. For this purpose, an axial shifting force F1 is exerted on the working rolls (1) and (1') in one direction or the other.

On the other hand, according to another known arrangement, bending forces F2 are exerted on the ends of the shafts of the working rolls (1) and (1') by means of their chocks, so as to ensure bending of the corresponding roll.

As a result of the arrangement according to the invention, the working rolls (1) and (1') can be simultaneously subjected to an axial shifting force F1 and to the bending forces F2.

Figure 2:
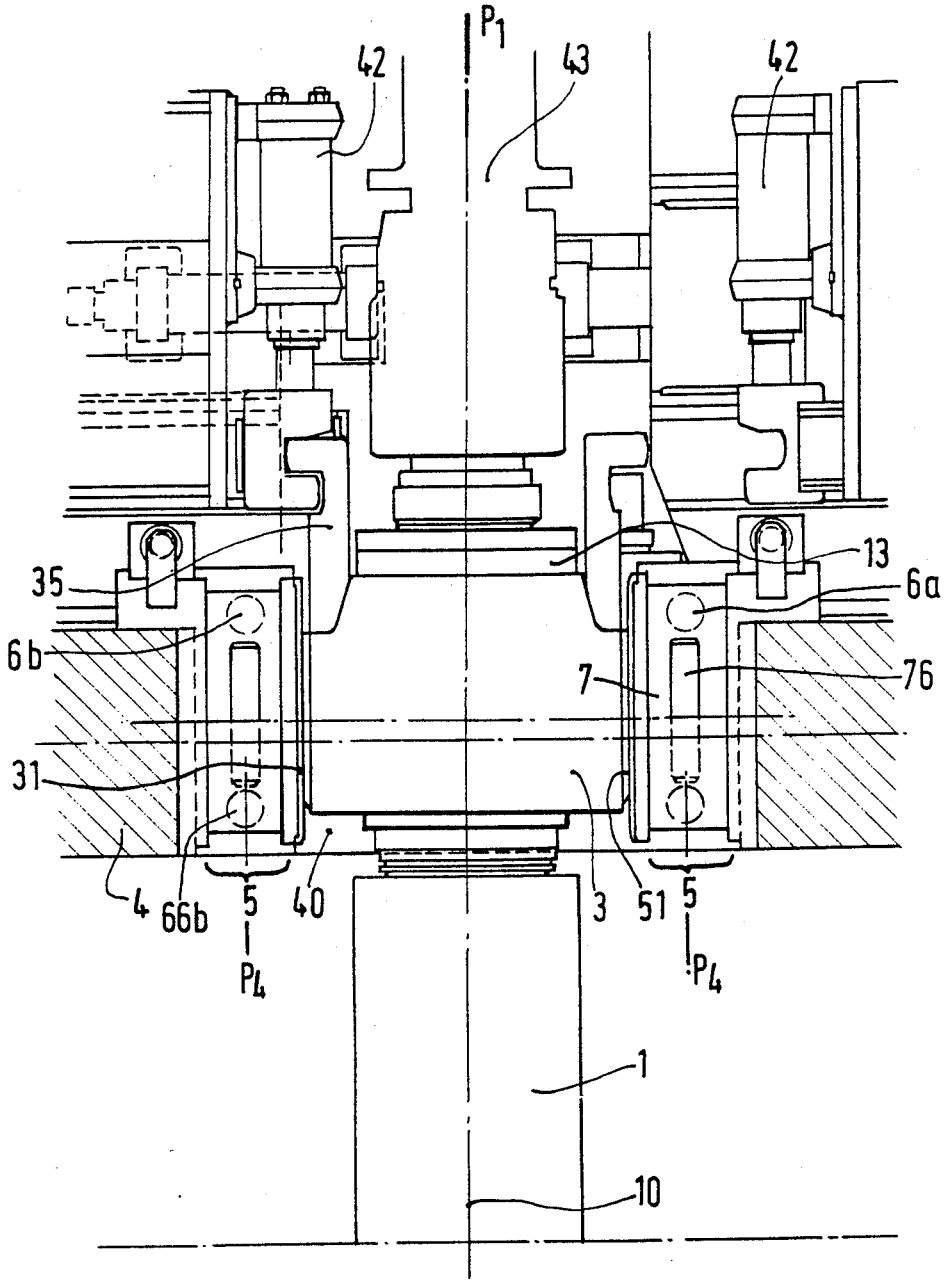
FIG. 2 is a partial plan view of a working roll and its shifting means.

FIG. 2 shows one end of a working roll with a chock, and a device for axial shifting. The working roll (1) is equipped at its two ends with journals centered, by means of rolling bearings, within chocks (3) forming bearing bodies and mounted so as to slide parallel to the gripping plane P1 in apertures (40) made in the two uprights (4) of the rolling-mill stand.

For this purpose, as shown in FIG. 2, each chock (3) of the working roll (1) is equipped with sliding faces (31) which are parallel to the gripping plane P1 and which can slide along corresponding faces (51) formed towards the inside on supporting blocks (5) secured in the apertures (40) of the stand (4) of the rolling mill.

Thus, each chock (3) guided between the two vertical faces (51) can shift in two directions, i.e., both vertically under the action of the bending device and parallel to the axis (10) of the roll under the action of the device for axial adjustment.

Various devices for the axial shifting of the rolls are known, but since these do not form the subject of the invention there is no need to describe them in detail.

In general terms, the axial shifting force exerted on one of the chocks must be exerted precisely along the axis of the roll, and for this purpose it is possible to use, for example, a single jack bearing on a control bar making it possible to exert the axial shifting force on the two sides of the chock.

However, if the shifted roll is a driving roll, it is also possible, as shown in FIG. 2, to use shifting jacks (42) fed in synchronism and arranged symmetrically on either side of the means (43) for driving the roll (1) in rotation, the chock (3) being equipped, on each side of the roll axis (10), with pawls (35) which engage in corresponding catching heads fixed to the rod of each jack (42). This catching can be made releaseable as a result of the lateral shift of the shifting jack (42), as shown in FIG. 2 for the right-hand jack.

On the other hand, each chock (3) of a roll (1) is fixed to the latter in the axial direction by means of a cover (13) for closing the stand of the rolling bearing, the latter being designed so as to be capable of absorbing axial forces, for example in the form of tapered rolling bearings. Thus, the axial shifting force exerted by the jacks (42) on one of the chocks (3) is transmitted to the working roll and to the second chock located at the other end of the latter.

On the other hand, each chock (3) is associated with a bending assembly which, as shown in FIG. 2, is composed of two pairs of jacks (6*a*, 66*a*) and (6*b*, 66*b*) arranged respectively on either side of the gripping plane P1 on which the axis of the roll 1 is centered.

Figure 1:
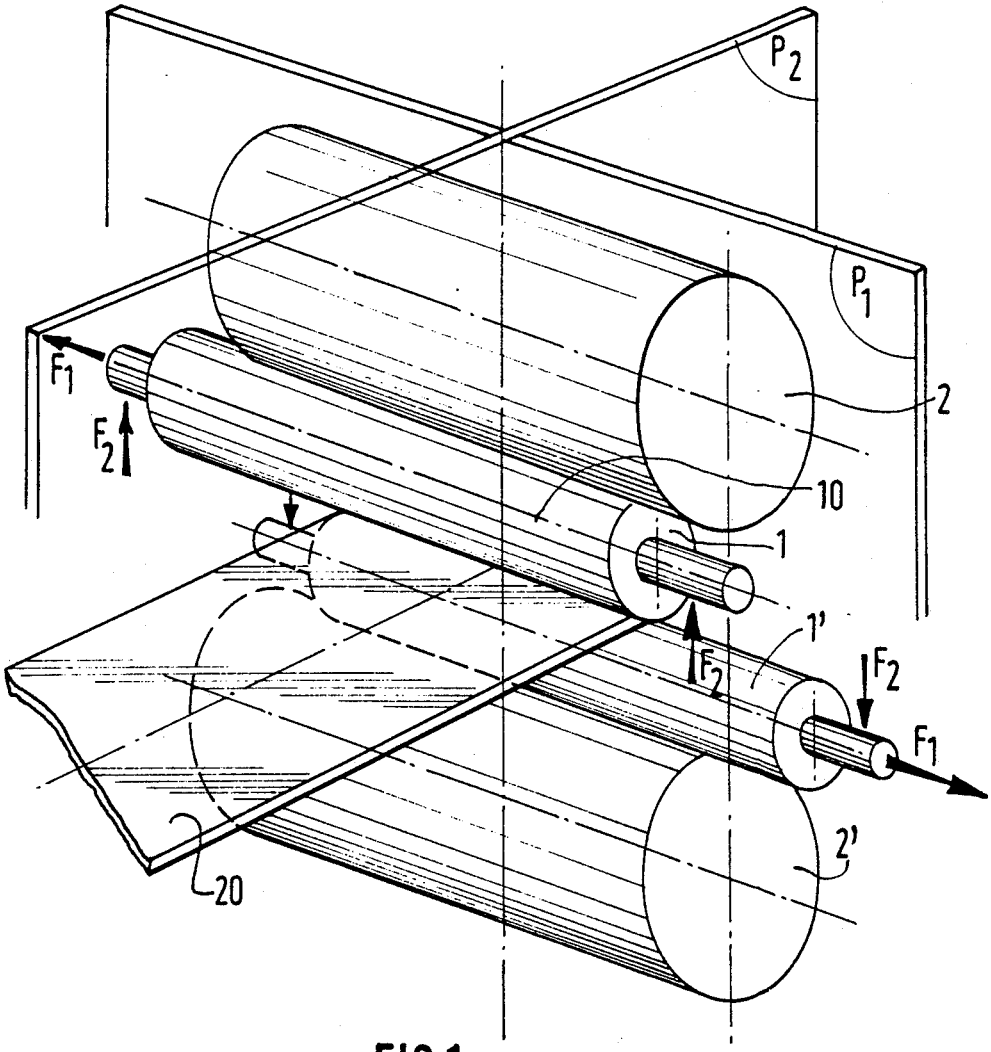
FIG. 1 is a schematic perspective view of the arrangement of a four-high rolling mill with shiftable rolls.

It is known that it is possible to obtain either so-called "positive" bending, in which the opposite chocks of the two working rolls move apart from one another, or "negative" bending, in which the opposite chocks approach one another. However, it is generally necessary to prevent the chocks from approaching one another because this causes crushing on the edges of the metal sheet in relation to the central part, and consequently, in the most usual case shown in the drawings, only positive bending is carried out, i.e., bending in the direction of movement of the chocks away from the passage plane of the metal sheet, as indicated by arrows $F_2$ of FIG. 1.

Figure 6:
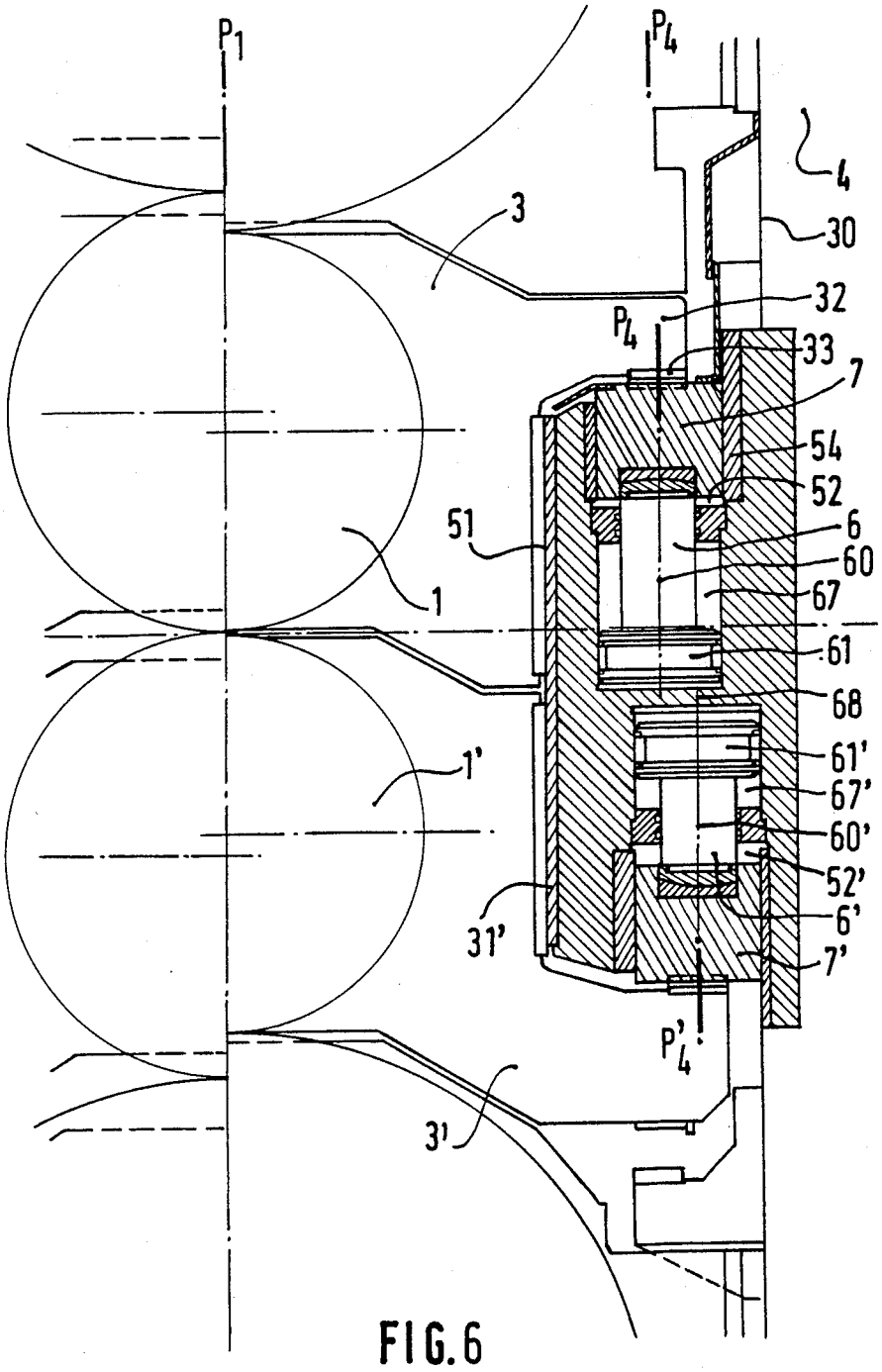
FIG. 6 is a view of the chocks of the two working rolls and of the bending devices in a section taken in a plane perpendicular to the rolling plane and passing through the axes of the bending jacks.

For this purpose, as can be seen from FIG. 6, each chock (3) is extended beyond the sliding faces (31) by bearing parts (32) in the form of lugs extending above the supporting block (5) in which the bending jacks (6) are accommodated. However, the bending force is not exerted directly on the chocks (3), but on intermediate pieces (7) which are interposed between the bending jacks (6) and the corresponding bearing parts (32).

Each supporting block (5) is common to the two working rolls (1) and (1') and is provided at each end, at the top and bottom, with a transverse recess (52) limited by two spaced-apart faces (54) parallel to the gripping plane. Each intermediate piece (7) is equipped with an outer horizontal part (70) seated in the recess (52) and guided in a translational movement along corresponding sliding faces on the two opposite faces (54) of the receptacle (52).

Each intermediate piece (7) preferably has the form of a T, the outer part (70) forming two horizontal wings (75) extending symmetrically on either side of a vertical central part (73) cenered in the mid-plane P3 of the supporting block (5) perpendicular to the gripping plane P1, i.e., the vertical plane of symmetry of the two pairs of bending jacks, in which the chock (3) of each of the two working rolls (1 and 1') is centered when the latter are themselves aligned and centered on the mid-plane P2 of the stand.

The two bending jacks (6*a*, 66*a*) symmetrical relative to the plane P3 each consist of a piston (62) mounted for vertical sliding movement in a bore (67) in the supporting block (5).

The vertical central part (73) of the intermediate piece (7) extends vertically between the two jacks (6*a*, 66*a*) and engages in a machined portion (53) forming a central well which is made in the supporting block (5) between the bores (67) of the two jacks (6*a*, 66*a*) and which extends the transverse recess (52), in which the two wings (75) of the intermediate piece (7) extend in order to fit above the two jacks (6*a*, 66*a*).

The central part (73) forms a guide foot of the intermediate piece (7), mounted so as to be vertically slidable between two guide faces (55) which are parallel to the plane P3 and are set apart from one another symmetrically on either side of the latter and which form the two opposite faces of the central machined portion (53).

The same arrangement is adopted for the bending jacks (6'*a*, 66'*a*) of the lower roll (1'). The supporting block (5) common to the two working rolls (1 and 1'), is therefore symmetrical relative to both vertical plane P3 to a horizontal plane.

To produce the bending assemblies (6 and 6') associated with the two rolls, two bores (67 and 67') are made in the block (5), on either side of the plane of symmetry P3, and are separated by a central partition (68) and open into the transverse recesses (52, 52') which are formed respectively in the two upper and lower faces of the block (5) and in which engage the upper parts (70, 70') of the two intermediate pieces (7, 7'), on which bear respectively the chocks (3 and 3') of the two working rolls (1 and 1'). Each bore (67) is closed sealingly by means of a partition (63) forming the bottom of the transverse recess (52) and limiting the chamber of the jack (6) which, on the opposite side, is closed by means of the partition (68) and inside which slides the piston (61) extended by a rod (62) passing through the partition (63) in order to bear on the corresponding wing (75) of the intermediate piece (7).

Figure 7:
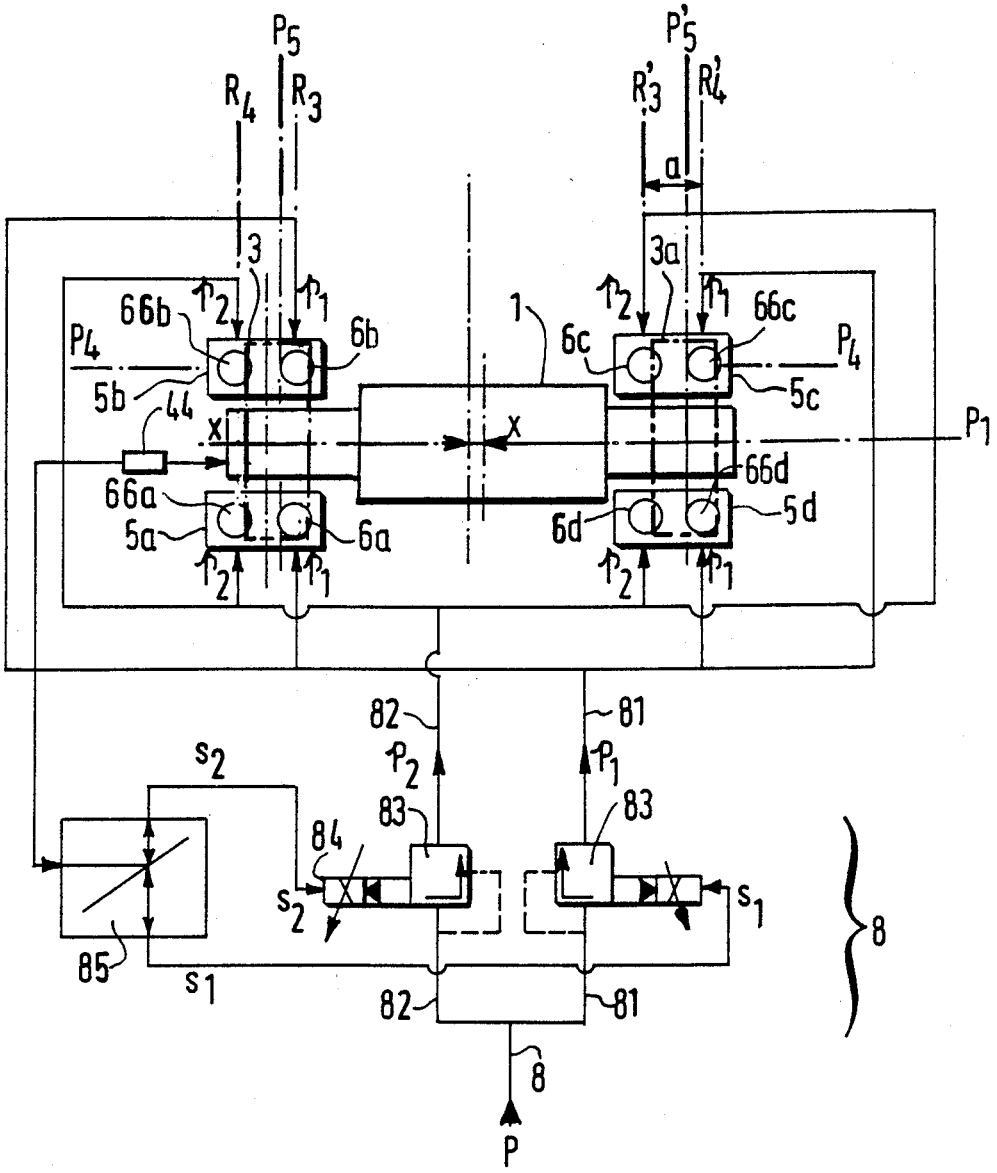
FIG. 7 is a hydraulic diagram of the balancing device in a further-improved embodiment.

The two pairs of jacks (6a, 66a) (6'a, 66'a) formed in this way on the two faces of the supporting block (5) can be fed by means of hydraulic circuits, as illustrated in FIG. 7, the supporting piece (5) thus constituting a proper fixed hydraulic block.

Moreover, the bearing lug (32) of the chock (3) bears, by means of a thrust insert (33), on a smooth face (76) which is formed on the outer part (70) of the intermediate piece (7) and along which the thrust insert (33) can therefore slide continuously, following the axial shifts of the roll (1).

Figure 4:
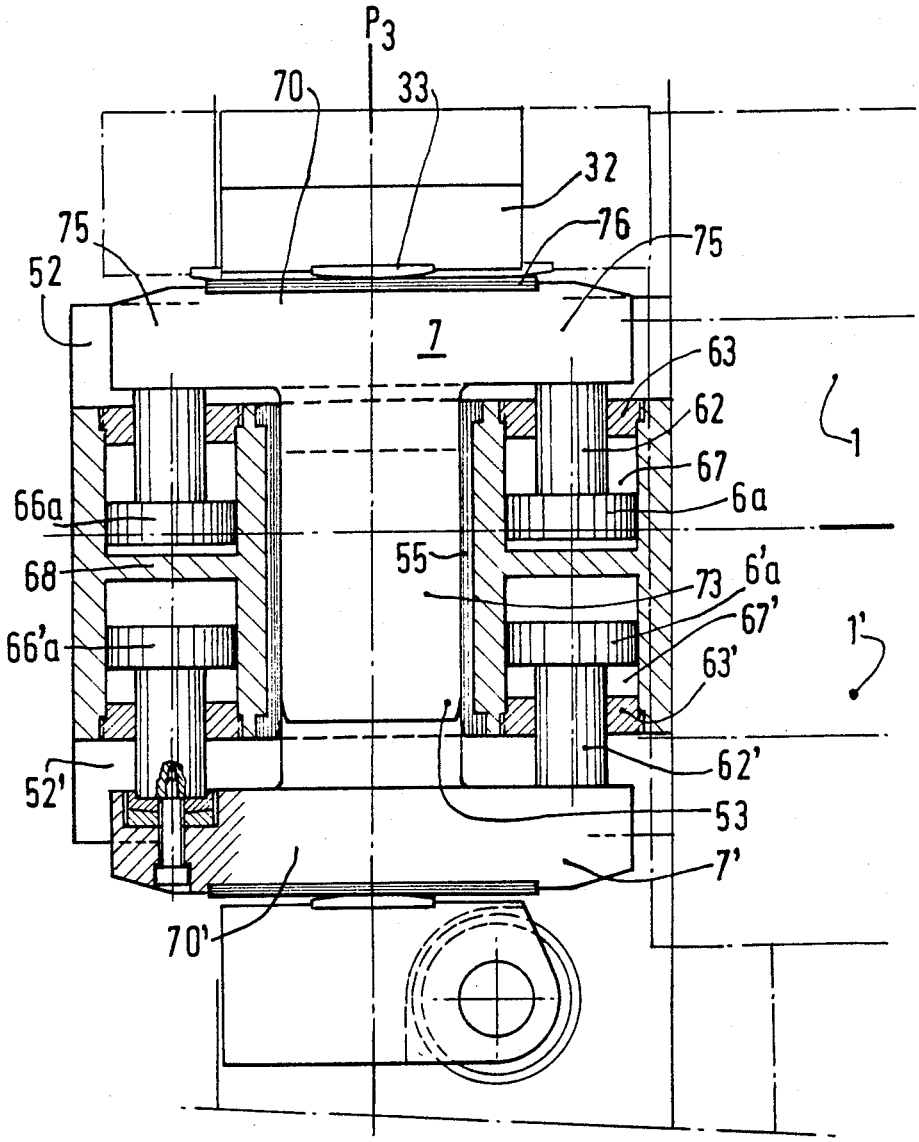
FIG. 4 is a partial view of the bending devices in a section taken in a plane parallel to the rolling plane and passing through the axes of a set of bending jacks, in the embodiment using separate intermediate T-shaped pieces.

The thrust insert (33) is arranged in the transverse plane of symmetry of the chock (3) and is therefore centered in the plane P3 in the position shown in FIG. 4, where the working rolls (1) and (1') are aligned and centered in the mid-plane P2 of the stand.

Because of the supporting block (5) is common to the two bending systems (6 and 6') of the two working rolls (1 and 1'), the central parts (73, 73'), forming a guide foot, of the two intermediate pieces (7, 7') engage in one and the same machined portion (53) passing completely through the supporting block (5), in the axis of the latter, connecting the transverse recesses (52 and 52') to one another and passing between the chambers of the four bending jacks.

Figure 5:
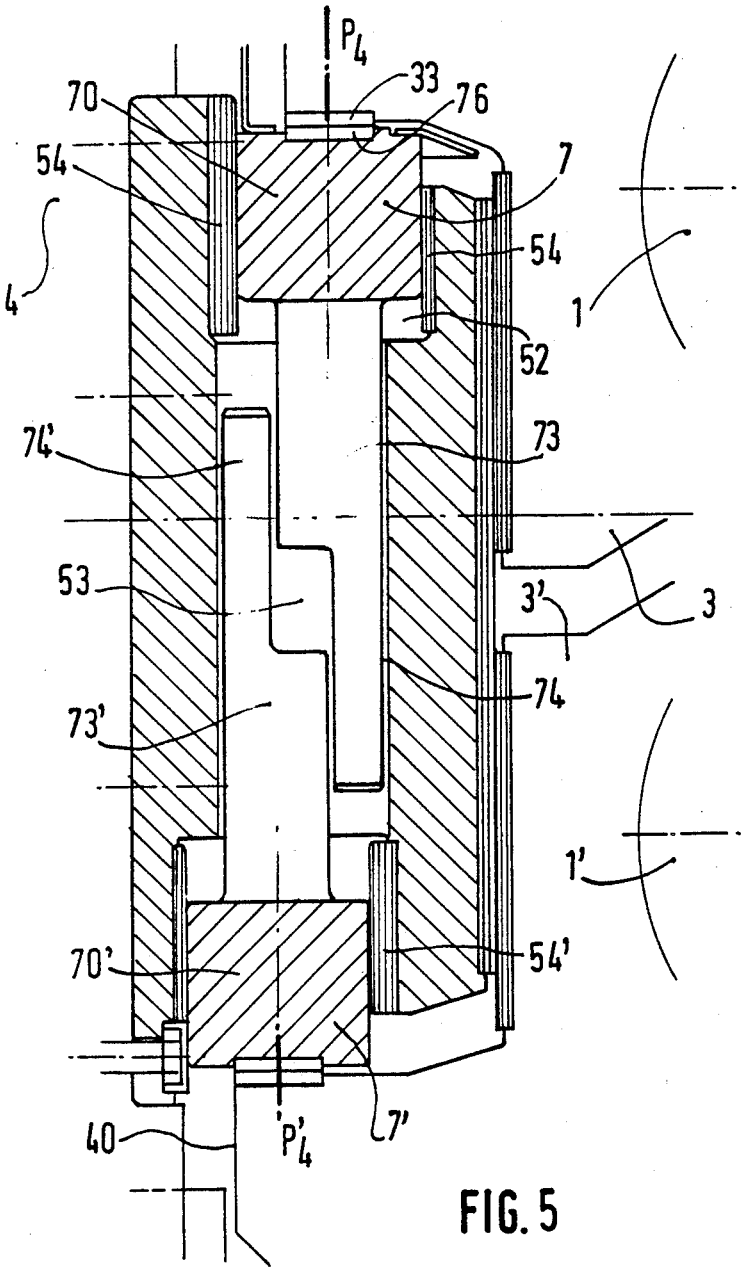
FIG. 5 shows the special cross-section of these pieces in a section taken in a transverse plane, the chocks being set apart from one another.

As shown in FIG. 5, the guide foot (73) of each intermediate piece (7, 7') is provided, at its end opposite the outer part (70), with an L-shaped indentation forming a thinned part (74) offset laterally, so that the two guide feet (73, 73') can overlap in the middle part of the central machined portion (53). Thus, each guide foot (73, 73') can be guided virtually over the entire length of the guide faces (55) formed over the full height of the central machined portion (53).

Moreover, in the axial direction, the two bearing parts (33) of each chock are likewise centered in thrust planes P4 parallel to the gripping plane P1 and passing through the axes of the two corresponding bending jacks.

As can be seen in FIG. 5, the thrust planes P4, P'4 of the two bending assemblies associated with the chocks (3 and 3') and arranged in one and the same supporting block (5) are offset on either side of the plane of symmetry of the supporting block (5) on which the machined portion (53) is centered.

When an axial shift of one of the rolls, for example the working roll (1), is caused by means of the jacks (42), the corresponding thrust insert (33) slides on the smooth face (26) of the intermediate piece (7) on one side or the other of the plane of symmetry P3. If a bending force is exerted at the same time on the roll, each sliding piece (7) shifts vertically as a result of its guide foot (73) which opposes the tilting torque arising as a result of the offset of the thrust insert (33) in relation to the plane of symmetry of the forces exerted by the jacks.

The invention thus makes it possible to carry out the axial adjustment and the bending of a working roll at the same time, and if, as usually happens, the axial shifts remain relatively small, the tilting torque of the intermediate piece (7) arising as a result can easily be absorbed by means of the interlocking effect of the guide foot (7).

This avoids the need to increase the pressures on the surfaces of vertical guidance, which could increase friction and impair the efficiency of thickness adjustment.

However, if greater axial shifts are to be carried out, the resulting tilting torque arising from this can cause excessive frictional forces capable of disrupting the shifting of the chock. It is then preferable to add to the interlocking effect of the guide foot other arrangements which make is possible to reduce friction by balancing the forces exerted.

Various means can be used for this purpose.

Figure 3:
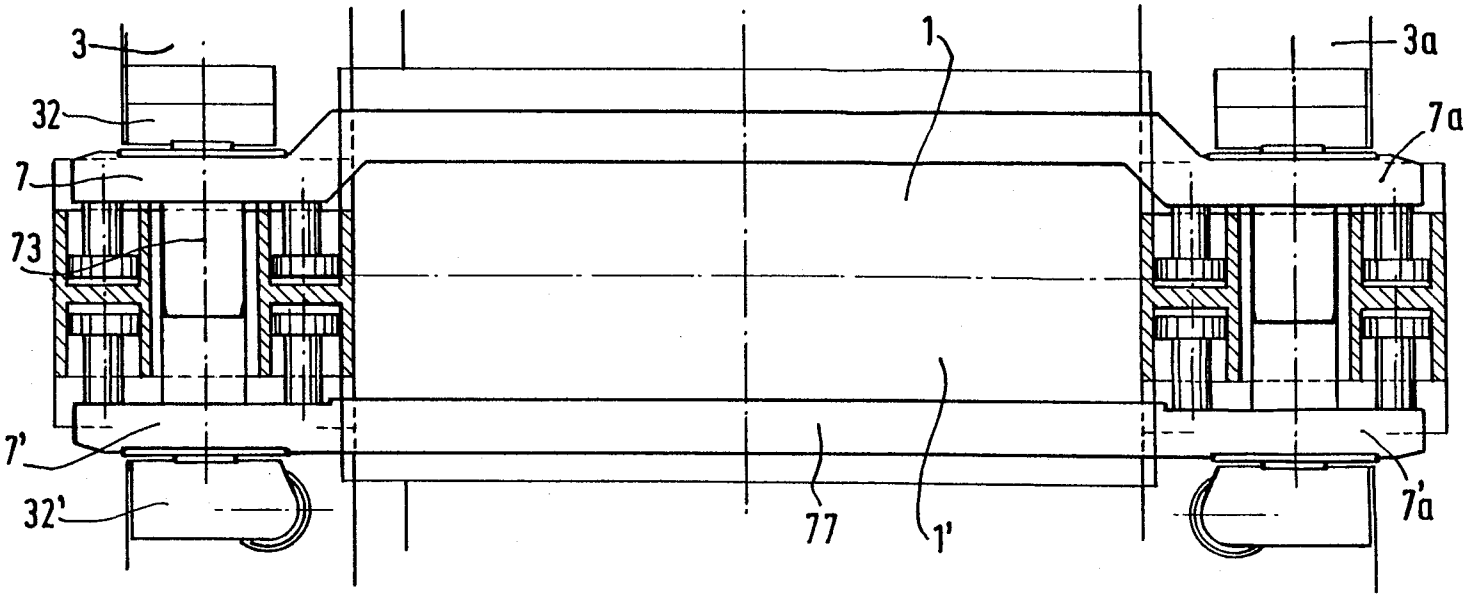
FIG. 3 is a partial view of the rolling-mill stand, showing the two working rolls and the bending devices in a section taken in a plane parallel to the rolling plane and passing through the axes of a set of bending jacks, in an embodiment using continuous beams passing through the stand and having T-shaped ends.

Thus, in the embodiment illustrated in FIG. 3, the intermediate pieces (7) and (7a) corresponding to the two chocks (3) and (3a) of each roll (1) and arranged at the same level in relation to the axis of the roll are integral with a beam (77) extending along the roll parallel to its axis. The dimensions of this beam (77) can be selected so that it absorbs the tilting torques of the pieces (7) and (7a) attributable to the shifting of the chocks (3) and (3a).

However, this simple arrangement may have the disadvantage that the four beams (77) extend between the two uprights of the stand near the working rolls, i.e., in a space which it is expedient to keep free.

Consequently, in a preferred embodiment, the forces exerted by the bending jacks are balanced as a function of the position of the corresponding chock.

According to one of the essential characteristics of the invention, the offset of the shifted roll (1) relative to the mid-plane P2 of the stand is measured by means of a displacement sensor (44) comprising two parts sliding relative to one another, fastened, for example, to the two parts of one of the jacks (42), and supplying an analog or digital signal proportional to the offset of the working roll relative to the centering position in the mid-plane P2 and of a sign corresponding to the direction of the offset. This signal is used to balance the pressures in the bending jacks by means of a device (8) shown diagrammatically in FIG. 7.

This figure illustrates by way of example a shiftable roll (1) and its two bending devices, each comprising two sets of jacks arranged in hydraulic blocks (5a, 5b, 5'c, 5'd), each set comprising two jacks (6a, 66a) (6b, 66b), (6'a, 66'a), (6'b, 66'b).

Conventionally, the reference 6 is allocated to the bending jacks arranged on the same side as the roll, i.e., towards the inside of the stand, and the reference 66 is allocated to the jacks arranged towards the outside.

The four jacks associated with each chock are arranged in the way described above and are centered in two transverse plane R3 and R4 located at a distance e from one another.

The hydraulic blocks (5a, 5b) and (5c, 5d) of the two chocks are connected by means of a single feed circuit (80) to a pressurized-fluid source (not shown), but the circuit (80) is divided into two branches (81) and (82) making it possible to feed at the same pressure the jacks arranged on the same side of the chock in the direction of axial shift. The branch (81) thus feeds in parallel the jacks (6a, 6b) and (66c, 66d) of the two rows R3 and R'4 located on the right in FIG. 7, while the branch 82 feeds in parallel the jacks (*66a, 66b*) and (*6c, 6d*) of the two rows R4 and R'3 located on the left.

The hydraulic circuit is organized so that, whatever the pressures, all the jacks are fed at the same rate so as to produce equal shifts at the same speed.

Each branch (81), (82) of the feed circuit (8) is equipped with a pressure regulator (83) which, as a function of the signals received at its input (84), regulates the pressure in the corresponding circuit, but maintains a constant flow rate there.

Each roll (1) is associated with a sensor (44) which detects the axial shifts and which supplies an analog or digital signal proportional to the shift and applied to a computation unit (85).

On the basis of the signals received, the latter prepares the desired pressure values S1 and S2 applied to the inputs ($^{8}$4) of the pressure regulators (83) of the two branches (81) and (82) as a function of a preprogrammed law making it possible to ensure such a distribution of the pressures P1 and P2 that the sum of the torques arising as a result of the thrust forces exerted by the bending jacks in the planes P4 and the reaction of the bearing part (32) of the corresponding chock on the T-shaped piece is zero. Thus, even in the centering position of the rolls (1) in the mid-plane P2 of the stand, the two rows of jacks R3 and R4 need not be symmetrical relative to the mid-plane P5 of the rolling bearing of the chock, and this makes it possible to arrange the jacks in the most suitable way inside the hydraulic blocks (5), the plane of symmetry of which does not necessarily coincide with that of the rolling bearing.

The various members used for balancing the pressures can be replaced by means performing the same functions, and these means can be hydraulic, electrical or even mechanical (cam, lever arm, etc). In general, any technology for measuring shifts, for calculating corrections and for balancing pressures can be used to obtain the desired result.

It will also be seen that, as indicated in the lefthand part of FIG. 6, the fixed bending devices according to the invention can adapt to different roll diameters and/or to a variation in a diameter attributable to wear, within the limit of the stroke of the jacks.

Finally, the invention has been described with regard to a rolling mill with positive bending only, but the same arrangements could be used to carry out the bending of each roll in both the positive direction and the negative direction.

Without any substantial change in the embodiment described above, it would be sufficient, for example, to use double-acting jacks, the rods of which would be fastened to the bearing lugs of the chocks in order to act in one direction or the other.

However, it would also be possible, in another arrangement, to use single-acting jacks arranged in pairs on either side of the bearing part of the chock, each pair of jacks being associated with a T-shaped sliding piece.

We we claim is:

1. A rolling mill with axially shiftable rolls, said rolling mill comprising (a) a supporting stand having two uprights provided with apertures;

(b) at least two working rolls which bear on at least two back-up rolls along a rolling plane;

(c) chocks respectively carrying ends of each of said working rolls by means of rolling bearings;

(d) said chocks being slidably mounted in said uprights of said supporting stand, parallel to said rolling plane, each chock having two bearing parts;

(e) means for shifting at least one of said working rolls along its axis on either side of a centering position of said working rolls;

(f) supporting blocks fixed on either side of said apertures of said uprights and having sliding faces for corresponding chocks of corresponding working rolls;

(g) bending means for applying bending forces on said working rolls, said bending means comprising, for each chock, two symmetrical sets of at least two bending jacks respectively located in said supporting blocks;

(h) sliding pieces each mounted for vertical sliding movement in a housing machined inside each said supporting block, each machined housing comprising two pairs of parallel guide faces, respectively a first pair of guide faces parallel to said rolling plane and a second pair of guide faces perpendicular to said rolling plane;

(i) each sliding piece having a plane and smooth face parallel to the axis of the roll;

(j) each chock being provided with bearing lugs extending on each side of the chock above said supporting blocks and bearing on said plane face with the possibility of sliding, said bending jacks applying the bending forces on said sliding piece on the side opposite to said plane face.

2. The rolling mill as claimed in claim 1, wherein each of said sliding pieces comprises transverse parts for bearing each bending jack in a bending direction and extending horizontally above each said jack, and at least one guide foot part extending vertically between said second pair of guide faces for sliding guidance of said guide foot.

3. The rolling mill as claimed in claim 2, wherein said bending means comprises bending assemblies each comprising two jacks set apart from one another and centered in a plane parallel to said rolling plane, each of said sliding pieces having the shape of a T comprising a central part forming said guide foot inside said supporting block and extending vertically between said two jacks, and a widened outer part comprising two wings extending horizontally on opposite sides of said guide foot, each above one of said jacks.

4. The rolling mill as claimed in claim 2, wherein said two guide faces in the supporting block parallel to said rolling plane are set apart from one another symmetrically on either side of a thrust plane which passes through axes of said bending jacks and in which said bearing part of said chock is also centered, all of said bending forces thus being transmitted in said thrust plane.

5. The rolling mill as claimed in claim 3, wherein said machined housing comprises a transverse part which extends above the two bending jacks and in which is guided said widened outer part comprising said two wings of said sliding piece, and a central part forming a well in which said guide foot of said sliding piece is guided.

6. The rolling mill as claimed in claim 1, wherein, in each upright of said supporting stand, the bending assemblies of the two working rolls are mounted in/$^{a}$single supporting block having, on its two opposite faces, two transverse recesses connected by means of a single central machined housing passing between bending jacks.

7. The rolling mill as claimed in claim 4, wherein the guide foot of each sliding piece forms, on the same side as the corresponding chock, an interlocking head of a width sufficient to absorb tilting effects of said sliding piece during bending, and wherein an inner end of each said guide foot, on the opposite side to the corresponding chock, has, in cross-section taken in a plane parallel to the rolling plane, an L-shaped indentation forming a thinned part offset laterally relative to said thrust plane, so that the two thinned parts of two sliding pieces associated respectively with the two working rolls overlap in the central part of the single machined housing in the center of the supporting block.

8. The rolling mill as claimed in claim 7, wherein the two thrust planes of the bending assemblies associated respectively with the two working rolls are offset laterally on either side of the mid-plane of the central machined housing of the supporting block.

9. The rolling mill as claimed in claim 1, comprising a balancing device for the bending jacks, said balancing device comprising a means for measuring a shift of a roll in relation to a centering position of said roll, and means for individual adjustment, at any moment, of the pressure exerted on each bending jack as a function of a measured offset and of the position of the jack in question in relation to the mid-plane of the sliding piece, in such a way that the sum of the torques resulting from the bending forces and the reaction torque of the chock on the sliding piece is zero.

10. The rolling mill as claimed in claim 1, wherein the sliding pieces of the two chocks of one and the same roll which are located at the same level in relation to the axis of the roll are formed at two ends of a continuous beam extending parallel to the axis of the roll between the two corresponding uprights of said supporting stand.

11. A rolling mill as claimed in claim 9, wherein the two chocks of each roll are each associated with two symmetrical sets of bending jacks arranged on either side of the rolling plane, the jacks respectively arranged in each of the sets, in the same relative positions in relation to the mid-plane of their respective rolling bearings, being connected in parallel to one and the same branch of a common pressurized fluid feed circuit comprising as many branches as there are jacks in each set, each branch being provided with means for individual adjustment of fluid pressure, with equal flow rates being maintained in all of said branches.

12. The rolling mill as claimed in claim 11, wherein said means for individual adjustment of the pressures in the jacks comprise a servo-valve on each branch of the feed circuit, said servo-valves being controlled by a means for calculating, on the basis of a programmed law, corrections to be made to the pressures as a function of the offset measured and the respective positions of the jacks fed by means of the branch in question, in order to ensure correct distribution of the pressure force.

13. In a rolling mill with axially shiftable rolls, comprising, inside a supporting stand, at least two working rolls which bear on at least two back-up rolls along a rolling plane and having ends which are carried, by means of rolling bearings, in chocks adapted to be shifted in the supporting stand parallel to a rolling plane, at least one of said working rolls being associated, both with means for shifting said roll along an axis of said roll on either side of a centering position of said working rolls on a mid-plane of a rolled product, and with means for bending said roll, said bending means comprising, for each chock, two symmetrical sets of at least two bending jacks set axially apart from one another, the bending jacks of each chock being mounted on a fixed support integral with said supporting stand, said jacks being fed by means of a common hydraulic pressure, said jacks bearing in a direction of a bending force on T-shaped sliding pieces, a part of each of said sliding pieces forming a foot of a T being arranged so as to allow guidance in a translational movement in a vertical direction along a machined housing located in blocks containing said bending jacks, the improvement wherein said chocks of said working rolls each bear on a sliding piece, thereby receiving the bending force, said chocks shifting slidingly on said sliding pieces when said rolls are shifted axially, and wherein guidance of said sliding pieces in a vertical plane is effected by means which causes minimal loss resulting from friction in the vertical plane.

14. A rolling mill with axially movable rolls, said rolling mill comprising (a) a supporting stand having two uprights;

(b) at least two working rolls bearing along a rolling plane on at least two back-up rolls;

(c) chocks for supporting ends of said working rolls by means of bearings, each chock being slidably mounted in apertures in said uprights of said supporting stand parallel to said rolling plane, each bearing having a plane of symmetry;

(d) means for shifting at least one of said working rolls along an axis of said working roll on either side of a centering position of said working roll;

(e) supporting blocks fastened in said apertures of said uprights and having sliding faces for corresponding chocks of corresponding working rolls;

(f) bending jacks located in said supporting blocks and bearing on sliding pieces for applying bending forces on bearing lugs provided on each side of said chocks and extending above said supporting blocks;

(g) each bearing lug comprising a thrust insert arranged in the plane of symmetry of said chock;

(h) each thrust insert bearing slidably on a plane and smooth face formed on said sliding piece on the side opposite to said bending jacks and parallel to the axis of said working rolls;

(i) said sliding pieces transmitting bending forces applied by said jacks by shifting vertically and opposing a tilting torque arising from offset of said thrust insert in relation to the bending forces exerted by said jacks.

15. Process for adjusting the profile of axially shiftable rolls in a rolling mill comprising, inside a supporting stand, at least two working rolls which bear on at least two back-up rolls along a rolling plane and the ends of which are carried, by means of rolling bearings, in chocks mounted in the supporting stand so as to be movable parallel to a rolling plane, said process comprising the steps of (a) axially shifting at least one working roll in relation to a centering position in which said at least two working rolls are symmetrical relative to a mid-plane of said supporting stand, and (d) simultaneously bending the shifted roll by bringing to bear a bending force on said shifted roll ends, said bending force being exerted on each chock by means of two sets of at least two bending jacks set axially apart from one another, said bending force being exerted by means of fixed jacks bearing, on one side, on a supporting block fixed to said supporting stand and, on the other side, on an intermediate piece slidably guided on the supporting block in the direction of exertion of said bending force, so as to withstand tilting effects in the direction of axial shift of said rolls, said piece being provided, on the side of a corresponding chock, with a sliding surface on which the bearing part of said chock slides in the event of an axial shift of the corresponding roll.

16. A process as claimed in claim 15, wherein, to carry out the bending of the roll shiftable relative to said centering position, for each chock the individual pressure exerted by each jack is continuously adjusted as a function of the offset measured and the position at the same moment of the jack in question in relation to the mid-plane of the sliding piece, in such a way that the sum of the torques resulting from exertion of the bending forces and the reaction torque of the chock on the sliding piece is zero.

* * * * *